US009304454B2

(12) United States Patent
Suganuma et al.

(10) Patent No.: US 9,304,454 B2
(45) Date of Patent: Apr. 5, 2016

(54) FIXING DEVICE AND IMAGE FORMING APPARATUS INCORPORATING SAME

(71) Applicants: Takuya Suganuma, Kanagawa (JP); Jun Yura, Kanagawa (JP); Takeshi Uchitani, Kanagawa (JP); Masaki Sukesako, Ibaraki (JP); Hiroki Ishii, Kanagawa (JP); Hironobu Takeshita, Kanagawa (JP); Shogo Kezuka, Tokyo (JP)

(72) Inventors: Takuya Suganuma, Kanagawa (JP); Jun Yura, Kanagawa (JP); Takeshi Uchitani, Kanagawa (JP); Masaki Sukesako, Ibaraki (JP); Hiroki Ishii, Kanagawa (JP); Hironobu Takeshita, Kanagawa (JP); Shogo Kezuka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/449,418

(22) Filed: Aug. 1, 2014

(65) Prior Publication Data

US 2015/0050038 A1 Feb. 19, 2015

(30) Foreign Application Priority Data

Aug. 14, 2013 (JP) ..... 2013-168450

(51) Int. Cl.
*G03G 15/20* (2006.01)
*G03G 15/23* (2006.01)

(52) U.S. Cl.
CPC ..... *G03G 15/2039* (2013.01); *G03G 15/2042* (2013.01); *G03G 15/231* (2013.01); *G03G 15/2082* (2013.01)

(58) Field of Classification Search
CPC ..... G03G 15/2039; G03G 15/2042; G03G 15/2078; G03G 15/202
USPC ..... 399/67, 69, 334
See application file for complete search history.

(56) References Cited

FOREIGN PATENT DOCUMENTS

| | | | |
|---|---|---|---|
| JP | 04306688 A | * | 10/1992 |
| JP | 6-095540 | | 4/1994 |
| JP | 9-050202 | | 2/1997 |
| JP | 9-244448 | | 9/1997 |
| JP | 2001-343860 | | 12/2001 |
| JP | 2002049266 A | * | 2/2002 |
| JP | 2005-181946 | | 7/2005 |

OTHER PUBLICATIONS

Kishi et al. (JP 2001343860 A), Dec. 2001, JPO Computer Translation.*

U.S. Appl. No. 14/161,078, filed Jan. 22, 2014.

* cited by examiner

*Primary Examiner* — Erika J Villaluna

(74) *Attorney, Agent, or Firm* — Oblon, McClelland, Maier & Neustadt, L.L.P.

(57) ABSTRACT

An image forming apparatus includes a fixing member, a pressing member, heat generators, temperature detectors, a power source, and a heat controller. The heat generators include a first heat generator and second heat generators corresponding to an imaged area and a blank area, respectively, of a recording medium. The heat controller controls a power source according to data provided by the temperature detectors, such that a heating area of the fixing member heated by one of the second heat generators located adjacent to the first heat generator acquires a temperature of T1−ΔT, where T1 is a temperature corresponding to the imaged area higher than a temperature T2 corresponding to the blank area, and ΔT is a temperature lower than a difference between T1 and T2. The heat controller changes ΔT between when a first side thereof is printed upon duplex printing and upon single-sided printing.

11 Claims, 7 Drawing Sheets

FIG. 9

| | PAPER TYPE NOT SPECIFIED | RECYCLED PAPER | COATED PAPER | ENVELOPE | OHP |
|---|---|---|---|---|---|
| THIN PAPER (52-59gsm) | 10 | 7 | – | – | – |
| PLAIN PAPER (60-81gsm) | 18 | 15 | – | – | – |
| MEDIUM THICK PAPER (82-105gsm) | 30 | 22 | – | 2 | – |
| THICK PAPER 1 (106-169gsm) | 40 | 30 | 40 | 2 | – |
| THICK PAPER 2 (167-210gsm) | 40 | 40 | 40 | 2 | – |
| THICK PAPER 3 (211-256gsm) | 40 | 40 | 40 | 2 | – |
| OHP | – | – | – | – | 40 |

FIG. 10

| | PAPER TYPE NOT SPECIFIED | RECYCLED PAPER | COATED PAPER | ENVELOPE | OHP |
|---|---|---|---|---|---|
| THIN PAPER (52-59gsm) | 0 | 0 | – | – | – |
| PLAIN PAPER (60-81gsm) | 2 | 0 | – | – | – |
| MEDIUM THICK PAPER (82-105gsm) | 2 | 0 | – | – | – |
| THICK PAPER 1 (106-169gsm) | – | – | – | – | – |
| THICK PAPER 2 (167-210gsm) | – | – | – | – | – |
| THICK PAPER 3 (211-256gsm) | – | – | – | – | – |
| OHP | – | – | – | – | – |

FIG. 11

| | PAPER TYPE NOT SPECIFIED | RECYCLED PAPER | COATED PAPER | ENVELOPE | OHP |
|---|---|---|---|---|---|
| THIN PAPER (52-59gsm) | 5 | 2 | – | – | – |
| PLAIN PAPER (60-81gsm) | 10 | 5 | – | – | – |
| MEDIUM THICK PAPER (82-105gsm) | 15 | 10 | – | – | – |
| THICK PAPER 1 (106-169gsm) | – | – | – | – | – |
| THICK PAPER 2 (167-210gsm) | – | – | – | – | – |
| THICK PAPER 3 (211-256gsm) | – | – | – | – | – |
| OHP | – | – | – | – | – |

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119(a) to Japanese Patent Application No. 2013-168450, filed on Aug. 14, 2013, in the Japan Patent Office, the entire disclosure of which is hereby incorporated by reference herein.

BACKGROUND

1. Technical Field

Embodiments of this disclosure generally relate to a fixing device and an image forming apparatus incorporating the fixing device, and more particularly, to a fixing device and an electrophotographic image forming apparatus, such as a copier, a printer, or a facsimile machine, incorporating the fixing device.

2. Description of the Related Art

Various types of electrophotographic image forming apparatuses are known, including copiers, printers, facsimile machines, or multifunction machines having two or more of the foregoing capabilities. In such image forming apparatuses, an electrostatic latent image is formed on a surface of a photoconductive drum serving as an image carrier. The electrostatic latent image thus formed is developed with toner serving as a developer into a visible toner image. The toner image is then transferred directly, or indirectly via a transfer belt onto a recording medium referred to as a sheet of paper, a recording sheet, a sheet, or a recording material with a transfer device so that the recording medium carries the toner image. Finally, the toner image is fixed onto the recording medium with a fixing device.

Such a fixing device typically includes a fixing member such as a roller, a belt, or a film, and a pressing member such as a roller or a belt. The pressing member is pressed against the fixing member to form a fixing nip therebetween. The toner image is fixed onto the recording medium under heat and pressure while the recording medium passes through the fixing nip.

SUMMARY

In one embodiment of this disclosure, an improved image forming apparatus is described that includes a rotatable fixing member, a pressing member, a plurality of heat generators, a plurality of temperature detectors, a power source, and a heat controller. The fixing member contacts an unfixed image. The pressing member is disposed opposite the fixing member to form a fixing nip between the pressing member and the fixing member. The plurality of heat generators are arrayed in a longitudinal direction perpendicular to a direction in which a recording medium is conveyed to heat respective heating areas of the fixing member. The plurality of temperature detectors are disposed to detect a surface temperature of the fixing member and temperatures of the plurality of heat generators. The power source supplies electric power to the plurality of heat generators to heat the respective heating areas. The heat controller controls the power source according to data provided by the temperature detectors, such that, when the unfixed image on the recording medium conveyed to the fixing nip contains an imaged area and a blank area, a temperature T2 corresponding to the blank area is lower than a temperature T1 corresponding to the imaged area. The plurality of heat generators include a first heat generator to heat a heating area of the fixing member corresponding to the imaged area and a plurality of second heat generators to heat heating areas corresponding to the blank area. The heat controller controls the power source such that a heating area of the fixing member heated by one of the plurality of second heat generators located adjacent to the first heat generator acquires a temperature of T1−ΔT, where ΔT is a temperature lower than a difference between the temperature T1 and the temperature T2. The heat controller also changes ΔT between when a first side of the recording medium is printed upon duplex printing and upon single-sided printing.

Also described is an improved fixing device incorporated in the image forming apparatus. The fixing device includes a rotatable fixing member, a pressing member, and a plurality of heat generators. The fixing member contacts an unfixed image. The pressing member is disposed opposite the fixing member to form a fixing nip between the pressing member and the fixing member. The a plurality of heat generators are arrayed in a longitudinal direction perpendicular to a direction in which a recording medium is conveyed to heat respective heating areas of the fixing member such that, when the unfixed image on the recording medium conveyed to the fixing nip contains an imaged area and a blank area, a temperature T2 corresponding to the blank area is lower than a temperature T1 corresponding to the imaged area. The plurality of heat generators include a first heat generator to heat a heating area of the fixing member corresponding to the imaged area and a plurality of second heat generators to heat heating areas corresponding to the blank area. A heating area of the fixing member heated by one of the plurality of second heat generators located adjacent to the first heat generator acquires a temperature of T1−ΔT, where ΔT is a temperature lower than a difference between the temperature T1 and the temperature T2. ΔT is different between when a first side of the recording medium is printed upon duplex printing and upon single-sided printing.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein:

FIG. 9 is a parameter table of ΔT specified for single-side printing;

FIG. 10 is a parameter table of ΔT specified for a first side of the sheet upon duplex printing; and FIG. 11 is a parameter table of ΔT specified for a second side of the sheet upon duplex printing.

Figure 1:
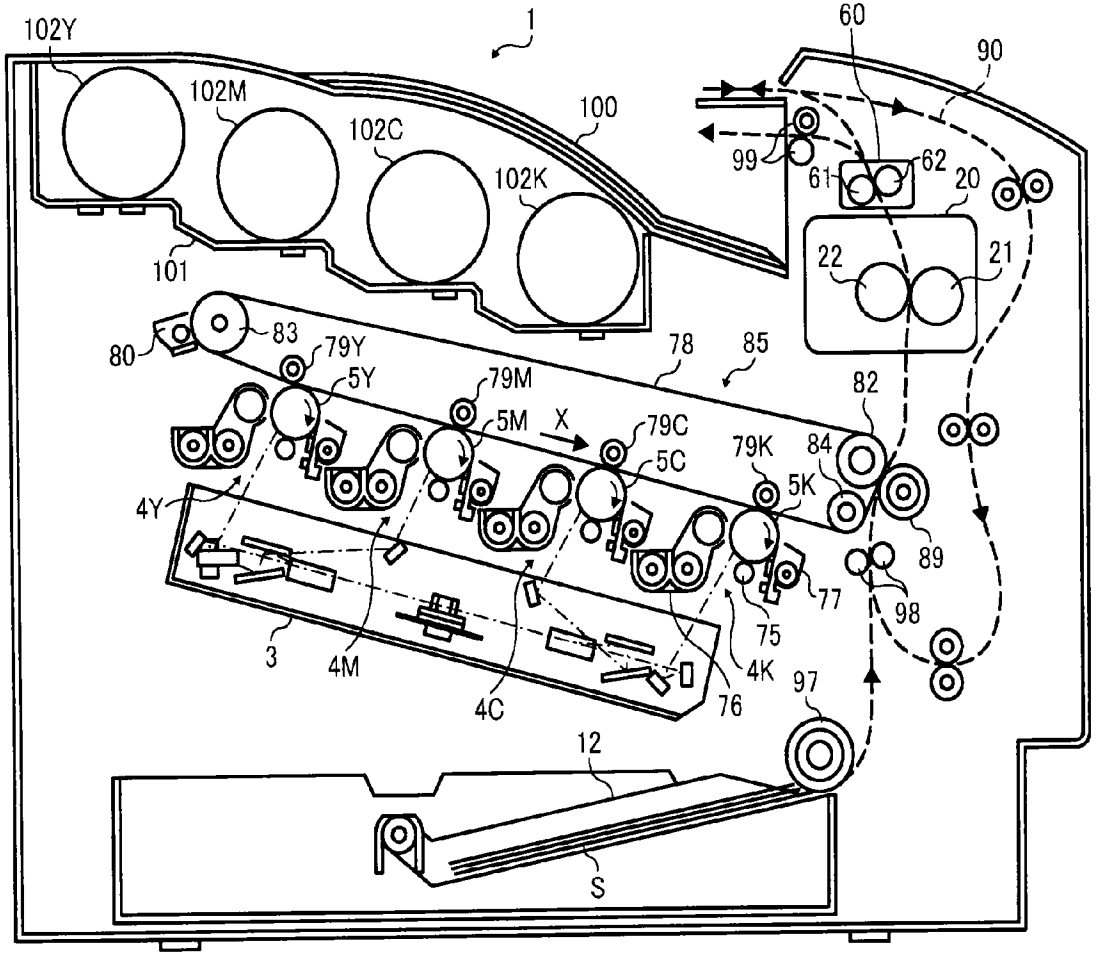
FIG. 1 is a schematic view of an image forming apparatus according to an embodiment of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

Referring now to the drawings, wherein like reference numerals designate identical or corresponding parts throughout the several views, embodiments of this disclosure are described below.

Initially with reference to FIG. 1, a description is given of a configuration and operation of an image forming apparatus 1 according to an embodiment of this disclosure.

FIG. 1 is a schematic view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like.

According to this embodiment, the image forming apparatus 1 is a tandem-type color printer. The image forming apparatus includes a bottle container 101 in an upper portion thereof. The bottle container 101 includes four toner bottles 102Y, 102M, 102C, and 102K, which are removable from the bottle container 101. The toner bottles 102Y, 102M, 102C, and 102K contains toner of yellow, magenta, cyan, and black, respectively. It is to be noted that, in the following description, suffixes Y, M, C, and K denote colors yellow, magenta, cyan, and black, respectively.

An intermediate transfer unit 85 is disposed below the bottle container 101. The intermediate transfer unit 85 includes an intermediate transfer belt 78, four primary-transfer bias rollers 79Y, 79M, 79C, and 79K, a secondary-transfer backup roller 82, a cleaning backup roller 83, a tension roller 84, and an intermediate transfer cleaner 80. The intermediate transfer unit 85 includes four imaging stations 4Y, 4M, 4C, and 4K. Each of the imaging stations 4Y, 4M, 4C, and 4K faces the intermediate transfer belt 78.

The imaging stations 4Y, 4M, 4C, and 4K includes photoconductive drums 5Y, 5M, 5C, and 5K, respectively. Each of the photoconductive drums 5Y, 5M, 5C, and 5K is surrounded by various pieces of imaging equipment, such as a charging device 75, a development device 76, a cleaning device 77, and a neutralizing device.

The photoconductive drums 5Y, 5M, 5C, and 5K are cylinders rotated by a drive source. In addition, each of the photoconductive drums 5Y, 5M, 5C, and 5K has a photosensitive surface. An exposure device 3 is disposed below the imaging stations 4Y, 4M, 4C, and 4K. The exposure device 3 irradiates the surfaces of the photoconductive drums 5Y, 5M, 5C, and 5K with light beams indicated by broken lines in FIG. 1 to form electrostatic latent images thereon according to image data read by an image scanner or image data obtained from a terminal via a network.

The charging devices 75 uniformly charge the respective surfaces of the photoconductive drums 5Y, 5M, 5C, and 5K. The charging devices 75 of the present embodiment contact the photoconductive drums 5Y, 5M, 5C, and 5K to charge the surfaces thereof.

The development devices 76 supply toner for the respective photoconductive drums 5Y, 5M, 5C, and 5K. The toner thus supplied adheres to the electrostatic latent images formed on the respective surfaces of the photoconductive drums 5Y, 5M, 5C, and 5K. Thus, the development devices 76 renders the electrostatic latent images formed on the respective surfaces of the photoconductive drums 5Y, 5M, 5C, and 5K visible as toner images. The development devices 76 of the present embodiment attach toner to the electrostatic latent images without contacting the photoconductive drums 5Y, 5M, 5C, and 5K.

The cleaning devices 77 of the present embodiment contact the respective surfaces of the photoconductive drums 5Y, 5M, 5C, and 5K with brushes to remove residual toner therefrom.

The intermediate transfer belt 78 is an endless belt having a base layer of resin film or rubber, on which the toner images are transferred from the photoconductive drums 5Y, 5M, 5C, and 5K to be a color toner image. The intermediate transfer belt 78 is entrained around the secondary-transfer backup roller 82, the cleaning backup roller 83, and the tension roller 84. The intermediate transfer belt 78 is rotated in a direction indicated by arrow X in FIG. 1 by rotation of the secondary-transfer backup roller 82. The color toner image is then transferred from the intermediate transfer belt 78 onto a recording medium S as an unfixed toner image.

A series of imaging processes, namely, charging, exposure, developing, primary transfer, and cleaning processes are performed on each of the photoconductive drums 5Y, 5M, 5C, and 5K. Accordingly, the toner images of yellow, magenta, cyan, and black are formed on the photoconductive drums 5Y, 5M, 5C, and 5K, respectively.

The primary-transfer bias rollers 79Y, 79M, 79C, and 79K and the photoconductive drums 5Y, 5M, 5C, and 5K sandwich the intermediate transfer belt 78 to form primary transfer nips, respectively. A transfer bias having a polarity opposite a polarity of the toner is applied to each of the primary-transfer bias rollers 79Y, 79M, 79C, and 79K.

Now, a detailed description is given of the series of imaging processes.

The photoconductive drums 5Y, 5M, 5C, and 5K are rotated in a clockwise direction in FIG. 1 by a driving motor. In the charging process, the surfaces of the photoconductive drums 5Y, 5M, 5C, and 5K are uniformly charged at a position opposite the respective charging devices 75.

In the exposure process, the photoconductive drums 5Y, 5M, 5C, and 5K are rotated further and reach a position opposite the exposure device 3, where the surfaces of the photoconductive drums 5Y, 5M, 5C, and 5K are scanned with and exposed by light beams emitted from the exposure device 3 to form the electrostatic latent images of yellow, magenta, cyan, and black on the surfaces of the photoconductive drums 5Y, 5M, 5C, and 5K, respectively.

In the developing process, the photoconductive drums 5Y, 5M, 5C, and 5K are rotated further and reach a position opposite the respective development devices 76, where the electrostatic latent images are developed with toner of yellow, magenta, cyan, and black into visible images, also known as toner images, of yellow, magenta, cyan, and black, respectively.

In the primary transfer process, the photoconductive drums 5Y, 5M, 5C, and 5K are rotated further and reach a position opposite the primary-transfer bias rollers 79Y, 79M, 79C, and 79K, respectively, via the intermediate transfer belt 78, where the toner images are transferred from the photoconductive drums 5Y, 5M, 5C, and 5K onto the intermediate transfer belt 78. The toner images formed on the surfaces of the photoconductive drums 5Y, 5M, 5C, and 5K through the developing process are transferred onto the intermediate transfer belt 78 while being superimposed one atop another to form a color toner image on the intermediate transfer belt 78.

At this time, a small amount of toner may remain untransferred on the surfaces of the photoconductive drums 5Y, 5M, 5C, and 5K as residual toner. In the cleaning process, the photoconductive drums 5Y, 5M, 5C, and 5K are rotated further and reach a position opposite the respective cleaning devices 77, where the cleaning devices 77 mechanically collect the residual toner on the surfaces of the photoconductive drums 5Y, 5M, 5C, and 5K with cleaning blades incorporated in the cleaning devices 77, respectively.

Finally, the photoconductive drums 5Y, 5M, 5C, and 5K are rotated and reach a position opposite the respective neutralizing devices, where residual potential is removed from the respective surfaces of the photoconductive drums 5Y, 5M, 5C, and 5K. Thus, the series of image forming processes performed on the surfaces of the photoconductive drums 5Y, 5M, 5C, and 5K is completed.

Now, a detailed description is given of a series of transferring processes.

The intermediate transfer belt 78 travels in the direction indicated by arrow X and successively passes through the primary transfer nips formed between the primary-transfer bias rollers 79Y, 79M, 79C, and 79K, on the one hand, and the photoconductive drums 5Y, 5M, 5C, and 5K, respectively, on the other. Thus, the toner images formed on the respective surfaces of the photoconductive drums 5Y, 5M, 5C, and 5K are primarily transferred onto the intermediate transfer belt 78 while being superimposed one atop another to form a color toner image thereon.

Then, the intermediate transfer belt 78 carrying the color toner image reaches a position opposite the secondary transfer roller 89, where the secondary-transfer backup roller 82 and the secondary transfer roller 89 sandwich the intermediate transfer belt 78 to form a secondary transfer nip. At the secondary transfer nip, the color toner image is transferred from the intermediate transfer belt 78 onto the recording medium S conveyed. At this time, a small amount of toner may remain untransferred on the intermediate transfer belt 78 as residual toner.

Then, the intermediate transfer belt 78 reaches a position opposite the intermediate transfer cleaner 80, where the residual toner is collected from the intermediate transfer belt 78. Thus, the series of transferring processes performed on the intermediate transfer belt 78 is completed.

Now, a detailed description is given of a series of image forming processes.

The recording medium S is fed from a paper tray 12 disposed in a lower portion of the image forming apparatus 1, and conveyed to the secondary transfer nip via, e.g., a feed roller 97 and a pair of registration rollers 98. The paper tray 12 accommodates a stack of recording media S, such as transfer sheets, one atop another. When the feed roller 97 is rotated in a counterclockwise direction in FIG. 1, an uppermost recording medium S of the plurality of recording media S is fed toward an area of contact, herein called a roller nip, between the pair of registration rollers 98.

The recording medium S conveyed to the pair of registration rollers 98 temporarily stops at the roller nip formed between the pair of registration rollers 98, as the pair of registration rollers 98 stops rotating. The pair of registration rollers 98 is rotated again to convey the recording medium S to the secondary transfer nip in synchronization with the movement of the intermediate transfer belt 78 carrying the color toner image to transfer the color toner image onto the recording medium S at the secondary transfer nip.

Thereafter, the recording medium S carrying the color toner image is conveyed to a fixing device 20. In the fixing device 20, the color toner image is fixed onto the recording medium S under heat and pressure applied by a fixing roller 22 and a pressing roller 21. Then, the recording medium S is conveyed to a toner cleaner 60 that removes unfixed toner from the recording medium S.

After the unfixed toner is removed, the recording medium S passes through a pair of discharge rollers 99, and is discharged onto a discharge tray 100 outside the image forming apparatus 1. Thus, the plurality of recording media S carrying output images rest one atop another on the discharge tray 100. Accordingly, the series of image forming processes is completed.

The image forming apparatus 1 further includes a sheet reversing device 90. The sheet reversing device 90 turns over the recording medium S to record images on both sides thereof and conveys the recording medium S to the pair of registration rollers 98 and further to the secondary transfer nip again.

The image forming apparatus 1 further includes a main controller and an operation input device. The main controller is a microcomputer including, e.g., a central processing unit (CPU), a read-only memory (ROM), a random-access memory (RAM), and an input/output (I/O) interface. The main controller executes programs that are preliminary stored in the ROM with the CPU.

The main controller is connected to, e.g., the operation input device, various sensors, motors and the like incorporated in the image forming apparatus 1. According to detection signals received from the sensors, the main controller controls the motors such as the drive motor to rotate the photoconductive drums 5Y, 5M, 5C, and 5K, and a drive mechanism to rotate the pressing roller 21 while controlling a power supply for a heater incorporated in the fixing device 20.

The operation input device is provided to the body of the image forming apparatus 1 and includes various keys, such as a numerical keypad and a print start key, and displays. The operation input device outputs signals inputted via the keys to the main controller.

Now, a detailed description is given of the toner cleaner 60.

As described later, the fixing device 20 is controlled to selectively heat an imaged area. In such a fixing device, a faulty image generated by, e.g., toner drops outside an imaged area, may remain unfixed on the recording medium S. The toner cleaner 60 removes such unfixed toner from the recording medium S.

The toner cleaner 60 includes a brush roller 61 and an opposed roller 62. The brush roller 61 physically scrapes the unfixed toner off the recording medium S. Alternatively, the toner cleaner 60 may remove unfixed toner by applying an electrostatic bias to a roller, by blowing air, by using an electrostatic brush that easily attracts toner, or the like.

Figure 2:
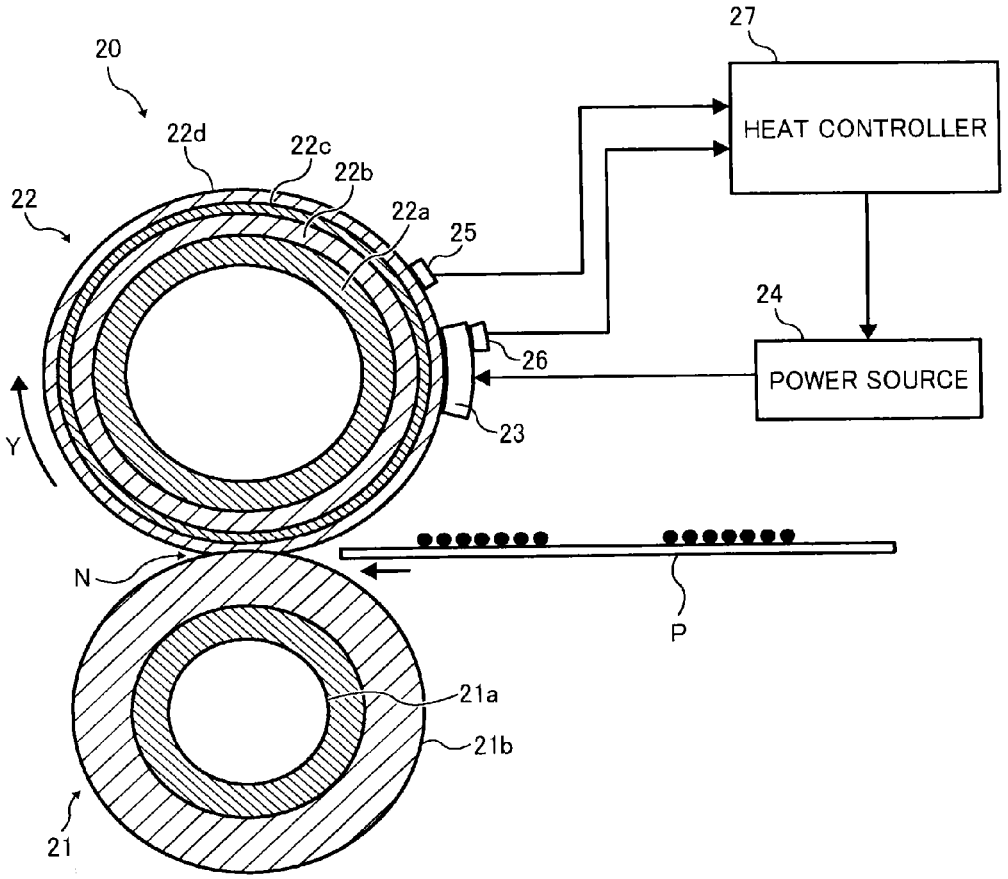
FIG. 2 is a schematic sectional view of a fixing device incorporated in the image forming apparatus of FIG. 1.
Figure 3:
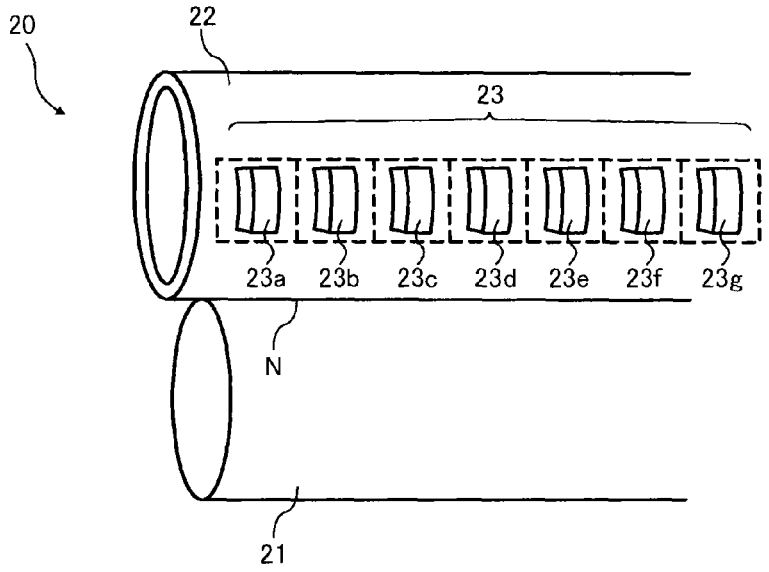
FIG. 3 is a partial side view of the fixing device of FIG. 2, illustrating a heater incorporated therein and heat generators of the heater.

Referring now to FIGS. 2 and 3, a detailed description is given of the fixing device 20 incorporated in the image forming apparatus 1.

FIG. 2 is a schematic sectional view of the fixing device 20 incorporated in the image forming apparatus 1 described above. FIG. 3 is a partial side view of the fixing device 20, illustrating the heater 23 and the heat generators 23*a* through 23*g* of the heater 23.

According to the present embodiment, the image forming apparatus 1 includes, e.g., a rotatable fixing member (e.g., fixing roller 22), a pressing member (e.g., pressing roller 21), a plurality of heat generators (e.g., heat generators 23*a* through 23*g*), a plurality of temperature detectors (e.g., thermistors 25 and 26), a power source (e.g., power source 24), and a heat controller (heat controller 27). The fixing member contacts an unfixed image. The pressing member is disposed opposite the fixing member to form a fixing nip (e.g., fixing nip N) between the pressing member and the fixing member. The plurality of heat generators are arrayed in a longitudinal direction perpendicular to a direction in which a recording medium (e.g., sheet S) is conveyed to heat respective heating areas of the fixing member. The plurality of temperature detectors are disposed to detect a surface temperature of the fixing member and temperatures of the plurality of heat generators. The power source supplies electric power to the plurality of heat generators to heat the respective heating areas. The heat controller controls the power source according to data provided by the temperature detectors, such that, when the unfixed image on the recording medium conveyed to the fixing nip contains an imaged area and a blank area, a temperature T2 corresponding to the blank area is lower than a temperature T1 corresponding to the imaged area. In addition, the heat controller controls the power source such that, a heating area of the fixing member heated by, of the plurality of heat generators, a heat generator corresponding to the blank area located adjacent to a heat generator corresponding to the imaged area acquires a temperature of T1−ΔT, where ΔT is a temperature lower than a difference between the temperature T1 and the temperature T2. The heat controller also changes ΔT between when a first side of the recording medium is printed upon duplex printing and upon single-sided printing.

Specifically, as illustrated in FIG. 2, the fixing device 20 of the present embodiment employs an external heating system. The fixing device 20 includes the fixing roller 22 serving as a fixing member, the pressing roller 21 serving as a pressing member disposed opposite the fixing member to form a fixing nip N between the pressing member and the fixing member, and a heater 23. In the present embodiment, the heater 23 is a thermal heater to heat the fixing roller 22. As illustrated in FIG. 3, the heater 23 is constructed of a plurality of heat generators, which, in the present embodiment, are seven heat generators 23*a* through 23*g*, arranged in a width direction of the sheet S, that is, a longitudinal direction of the fixing roller 22. The heat generators 23*a* through 23*g* heat their respective heating areas indicated by dotted lines in FIG. 3. The heat generators 23*a* through 23*g* can be controlled to individually heat their respective heating areas, and therefore, the temperature distribution of the fixing roller 22 can be controlled in the longitudinal direction thereof.

Referring back to FIG. 2, the fixing device 20 further includes the power source 24 connected with the heater 23 to supply electric power for the heater 23. Alternatively, the power source 24 and the heat controller 27 may be disposed outside the fixing device 20 in the image forming apparatus 1.

The thermistor 25 is disposed downstream from the fixing nip N and upstream from the heater 23 in a direction indicated by arrow Y in which the fixing roller 22 rotates. The thermistor 25 serves as a temperature detector to detect a surface temperature of the fixing roller 22. The thermistor 26 serves as a temperature detector to detect the temperature of the heater 23, specifically, the plurality of heat generators 23*a* through 23*g*.

The heat controller 27, which may be a part of the main controller or separate therefrom. The heat controller 27 is a microcomputer including, e.g., a CPU, a ROM, a RAM, and an I/O interface. The heat controller 27 executes programs that are preliminary stored in the ROM with the CPU to control the power source 24 to supply power for the plurality of heat generators 23*a* through 23*g* according to data provided by the thermistors 25 and 26.

The fixing roller 22 is constructed of a metal core 22*a*, a heat insulation layer 22*b*, a heat conductive layer 22*c*, and a release layer 22*d*. The metal core 22*a* is made of aluminum, having an outer diameter of about 40 mm and a thickness of about 1 mm. The heat insulation layer 22*b* coats an outer surface of the metal core 22*a*. The heat insulation layer 22*b* is made of silicone rubber, having a thickness of about 3 mm. It is to be noted that the heat insulation layer 22*b* may be made of foam silicone rubber to prevent heat diffusion and enhance heat insulation.

The heat conductive layer 22*c* is made of nickel and provided on the heat insulation layer 22*b*. Alternatively, the heat conductive layer 22*c* may be made of another material as long as the heat conductive layer 22*c* has a higher heat conductivity than at least the heat insulation layer 22*b*. For example, the heat conductive layer 22*c* may be made of an iron alloy such as stainless steel, or metal such as aluminum or copper. Alternatively, the heat conductive layer 22*c* may be a graphite sheet.

The heat conductive layer 22*c* reduces localized unevenness in surface temperature of the fixing roller 22 caused by uneven heating by the heater 23. Moreover, the heat conductive layer 22*c* increases the temperature of a slightly wider area than an area heated by the heater 23, thereby compensating a slight shift from an image. Accordingly, sizes of and intervals between the heat generators 23*a* through 23*g* of the heater 23 can be determined relatively freely over a wide design range.

The release layer 22*d* is provided on the heat conductive layer 22*c* to enhance the durability and maintain the releasing performance of the fixing roller 22. The release layer 22*d* is made of fluorine resin such as perfluoroalkoxy (PFA) or polytetrafluoroethylene (PTFE), having a thickness of about 5 μm to about 30 μm.

The pressing roller 21 is constructed of a metal core 21*a* and an elastic layer 21*b*. The metal core 21*a* is made of iron, having an outer diameter of about 40 mm and a thickness of about 2 mm. The elastic layer 21*b* coats an outer surface of the metal core 21*a*.

The elastic layer 21*b* is made of silicone rubber, having a thickness of about 5 mm. To enhance releasing performance, a fluorine resin layer having a thickness of about 40 μm may be provided on an outer surface of the elastic layer 21*b*.

It is to be noted that the pressing roller 21 is pressed against the fixing roller 22 by a biasing unit. The heater 23 is pressed against an outer surface of the fixing roller 22 by a biasing unit.

According to the present embodiment, the heater 23 contacts and heats the outer surface of the fixing roller 22. Alternatively, the heater 23 may be an induction heater provided with an excitation coil and an inverter to inductively heat the fixing roller 22 without contacting the fixing roller 22. The induction heater can control heating areas and heating amounts in a longitudinal direction with a configuration in which a plurality of heating coils are disposed or a plurality of members that cancel magnetic fluxes are disposed in the longitudinal direction.

For comparison, for energy efficiency, a comparative fixing device employs an external heating system to externally heat a roller as a fixing member to selectively heat an imaged area by setting a second temperature lower than a fixing temperature as a first temperature. Specifically, a fixing roller is heated from outside to fuse toner with heat accumulated around a surface of the fixing roller. Accordingly, warm-up time can be shorter and energy efficiency can be higher than with a fixing device employing an internal heating system to internally heat the entire fixing roller.

However, in the comparative fixing device, selectively heating an imaged area may cause a precipitous temperature difference in a longitudinal direction of the fixing member (i.e., temperature deviation in the longitudinal direction). Such a temperature difference may deform the fixing member and/or the pressing member facing the fixing member due to a thermal expansion difference and wrinkle the recording medium, causing conveyance errors and/or degrading image quality.

For example, the temperature of the fixing member may be controlled such that the fixing member has a higher temperature at the center in the longitudinal direction thereof (hereinafter simply referred to as center temperature) than a temperature at each end in the longitudinal direction thereof (hereinafter simply referred to as end temperature) to selectively heat the imaged area. In short, the fixing member has a larger thermal expansion at the center in the longitudinal direction thereof than a thermal expansion at each end in the longitudinal direction thereof. Particularly, in a fixing device such as the comparative fixing device that incorporates a drum-shaped fixing roller having a central portion of reduced diameter to prevent wrinkles in the recording medium, the fixing roller may be deformed and consequently lose the central portion of reduced diameter thereof. In other words, the fixing roller may have a center diameter equal to or larger than the end diameter due to thermal expansion if the fixing roller has a higher center temperature than the end temperature. In such a case, the fixing roller cannot sufficiently prevent wrinkles in the recording medium, increasing occurrence of wrinkles.

The recording medium may be wrinkled not only when the fixing member is heated at a higher center temperature than the end temperature, but also when the fixing member has a temperature deviation in the longitudinal direction thereof, for example, when only one side is heated. The recording medium may be wrinkled even if the fixing member is not a drum-shaped roller having a central portion of reduced diameter. For example, a cylindrical fixing roller may wrinkle the recording medium. In addition, the recording medium may be wrinkled not only in fixing devices employing a roller as a fixing member, but also in fixing devices employing a belt or a film as a fixing member. Moreover, the recording medium may be wrinkled in fixing devices employing a heating system other than the external heating system.

Upon duplex printing, generally, a first side of the recording medium passes through the fixing nip, and then a second side of the recording medium passes therethrough. The second side of the recording medium is more likely to be wrinkled than the first side of the recording medium.

By contrast, in the image forming apparatus 1 according to the embodiments of this disclosure, the fixing device 20 selectively heats an imaged area to prevent wrinkles in the recording medium.

Referring now to FIGS. 4A through 11, a description is given of selective heat control performed by the fixing device 20 of the image forming apparatus 1. The image forming apparatus 1 enhances energy efficiency by controlling the heat generators 23*a* through 23*g* according to the image data.

Figure 4A:
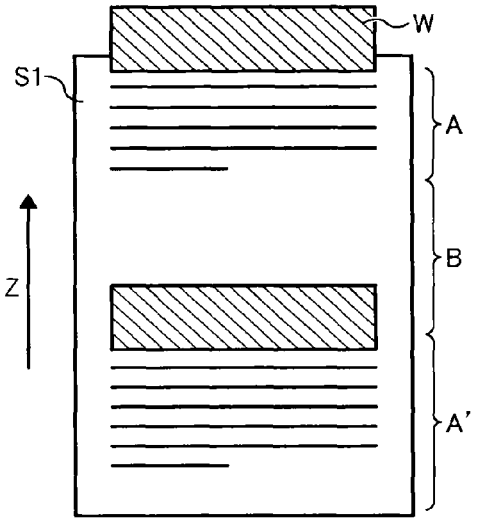
FIG. 4A is a plan view of a sheet, illustrating an image formation pattern including an imaged area, a blank area, and another imaged area, in that order, from a leading end of the sheet in a direction in which the sheet is conveyed.
Figure 4B:
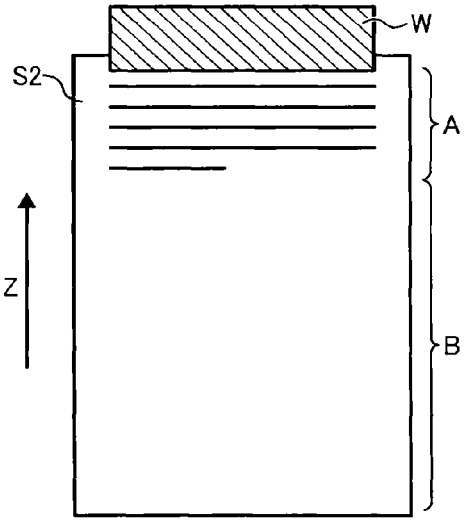
FIG. 4B is a plan view of a sheet, illustrating an image formation pattern including an imaged area and a blank area, in that order, from a leading end of the sheet in the direction in which the sheet is conveyed.

FIG. 4A is a plan view of a sheet S1, illustrating an image formation pattern including an imaged area A, a blank area B, and an imaged area A' in that order from a leading end of the sheet S1 in a direction indicated by arrow Z (hereinafter referred to as sheet conveying direction Z) in which the sheet S1 is conveyed. FIG. 4B is a plan view of a sheet S2, illustrating an image formation pattern including an imaged area A and a blank area B in that order from a leading end of the sheet S2 in the sheet conveying direction Z in which the sheet S2 is conveyed.

When the sheet S1 of FIG. 4A passes through the fixing device 20, the imaged areas A and A' are fixed while the blank area B is not fixed because the blank area B does not contain toner to be fixed on the sheet S1. On the other hand, when the sheet S2 of FIG. 4B passes through the fixing device 20, only the imaged area A located in a leading portion of the sheet S2 in the sheet conveying direction Z is fixed on the sheet S2.

For example, when the heat controller 27 receives image data of the image formation pattern illustrated in FIG. 4A from the main controller, the heat controller 27 controls the temperature of the fixing roller 22 such that a portion of the fixing roller 22 corresponding to the blank area B acquires a lower temperature than portions of the fixing roller 22 corresponding to the imaged areas A and A'. It is to be noted that a portion of the fixing roller 22 corresponding to an imaged area or a blank area is a portion of the fixing roller 22 that adheres to the imaged area or the blank area. The heat controller 27 controls the power supply for the heat generators 23*a* through 23*g*, thereby controlling the temperature of the fixing roller 22.

The portions of the fixing roller 22 corresponding to the imaged areas A and A' are heated to a fixing temperature T1 of, e.g., about 140° C. that is sufficient to fix a solid image on the sheet S1. By contrast, the portion of the fixing roller 22 corresponding to the blank area B is heated to a temperature T2 that is lower than the fixing temperature T1. A lower temperature T2 further enhances energy efficiency. However, if the temperature T2 is excessively low, it may take time to heat the fixing roller 22 to the fixing temperature T1 to fix a subsequent imaged area (e.g., the imaged area A' illustrated in FIG. 4A). Accordingly, the temperature T2 is preferably about 80° C. or higher. According to the present embodiment, the fixing temperature T1 is about 140° C., and the temperature T2 is about 100° C.

In FIGS. 4A and 4B, the electric power is supplied throughout the heater 23 so that the portions of the fixing roller 22 corresponding to the imaged areas A and A' acquire the fixing temperature T1, whereas the power supply for the heater 23 is reduced to heat the portion of the fixing roller 22 corresponding to the blank area B. It is to be noted that the power supply for the heater 23 is started to heat a portion of the fixing roller 22 corresponding to a preliminary heating area W, which is illustrated with hatching in each of FIGS. 4A and 4B, before heating the portion of the fixing roller 22 corresponding to the imaged areas A and A' that enters the fixing nip N. The preliminary heating area W is provided taking into account a heat generating length of the heater 23 in a circumferential direction thereof and the time taken to warm up the heater 23. Preferably, the preliminary heating area W is as small as possible for enhanced energy efficiency.

Figure 5A:
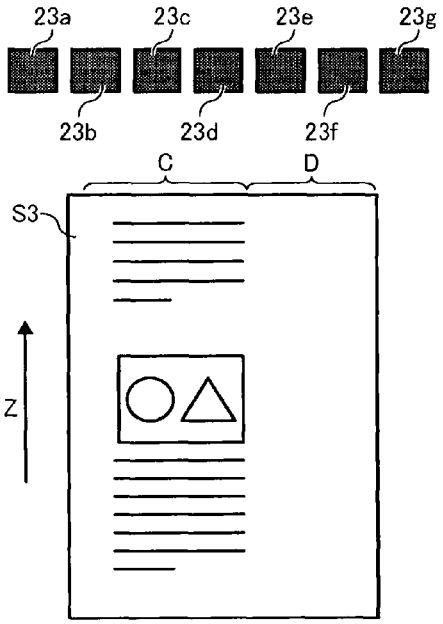
FIG. 5A is a plan view of a sheet, illustrating an image formation pattern including an imaged area and a blank area in a longitudinal direction of a fixing roller with the heat generators illustrated in FIG. 3.

FIG. 5A is a plan view of a sheet S3, illustrating an image formation pattern including an imaged area C and a blank area D in a longitudinal direction of the fixing roller 22, that is a width direction of the sheet S3, with the heat generators 23*a* through 23*g*. In this example, the heat generators 23*b*, 23*c*, and 23*d* are located corresponding to the imaged area C while the heat generators 23*e* and 23*f* are located corresponding to the blank area D.

Figure 5B:
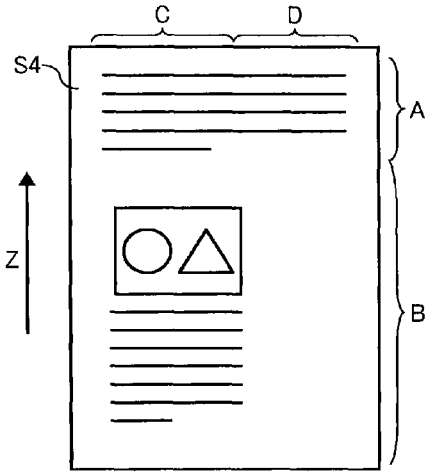
FIG. 5B is a plan view of a sheet, illustrating an image formation pattern including imaged areas and blank areas mixed in a width direction of the sheet and the direction in which the sheet is conveyed.

FIG. 5B is a plan view of a sheet S4, illustrating an image formation pattern including imaged areas A and C and blank areas B and D mixed in the width direction of the sheet S4 and the sheet conveying direction Z. In such a case, later-described control may be performed defining that the common area of the blank areas B and D is a blank area, and that the area except for the blank area of the sheet S4 is an imaged area.

Figure 6:
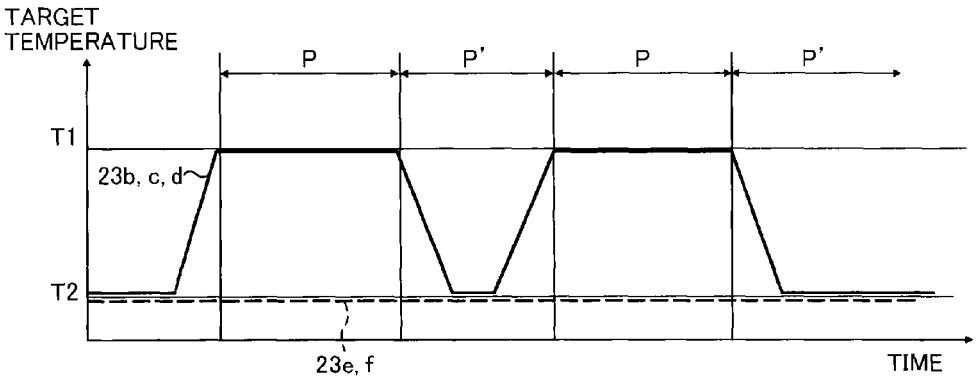
FIG. 6 is a graph of control temperatures of the heat generators to heat the sheet of FIG. 5A according to a comparative example of selective heat control.

FIG. 6 is a graph of control or target temperatures of the heat generators 23*b* through 23*f* when a plurality of sheets P3 having the same image formation pattern illustrated in FIG. 5A are supplied and heated according to a comparative example of selective heat control. In FIG. 6, P represents a time width in which the sheet S3 passes through the fixing nip N while P' represents a time interval between the sheets S3 passing through the fixing nip N.

The electric power is supplied for the heat generators 23*b* through 23*d* located corresponding to the imaged area C so that the heat generators 23*b* through 23*d* reach the temperature T1 as a target fixing temperature during P.

Then, the power supply is controlled to decrease the temperatures of the heat generators 23*b* through 23*d* down to the temperature T2, which is a temperature corresponding to a blank area, as a target temperature during P' because there is no image between the sheet S3.

The temperature T2 lower than the fixing temperature T1 contributes to reduction in energy consumption.

In the meantime, the power supply is controlled such that the heat generators 23*e* and 23*f* heat a portion of the fixing roller 22 corresponding to the blank area D at the temperature T2, regardless of P or P', because the blank area D does not contain toner to be fixed onto the sheet S3. It is to be noted that, in this example of FIG. 5A, heat control is not performed on the heat generators 23*a* and 23*g* because their heating areas are outside the width of the sheet S3.

In the comparative example of selective heat control, the power supply is controlled such that a portion of the fixing roller 22 heated by the heat generator 23*d* corresponding to the imaged area C acquires the temperature T1 while a portion of the fixing roller 22 heated by the heat generator 23*e* corresponding to the blank area D acquires the temperature T2, as illustrated in FIG. 6. In short, the fixing roller 22 is not uniformly heated in the longitudinal direction thereof. Such a temperature difference between adjacent heat generators, namely, the heat generators 23*d* and 23*e* may be a precipitous temperature difference in the longitudinal direction of the fixing roller 22 that causes a thermal expansion difference. As a result, the drum-shaped fixing roller 22 is deformed, losing its central portion of reduced diameter. Such deformed fixing roller 22 may wrinkle the sheet S3.

Hence, in the image forming apparatus 1 of the present embodiment, the heat controller 27 controls the power source 24 such that, a heating area of the fixing roller 22 heated by, of heat generators corresponding to a blank area, a heat generator located adjacent to a heat generator corresponding to an imaged area acquires a temperature of T1−ΔT, where ΔT is a target heating temperature difference lower than a difference between the fixing temperature T1 and the temperature T2.

Figure 7:
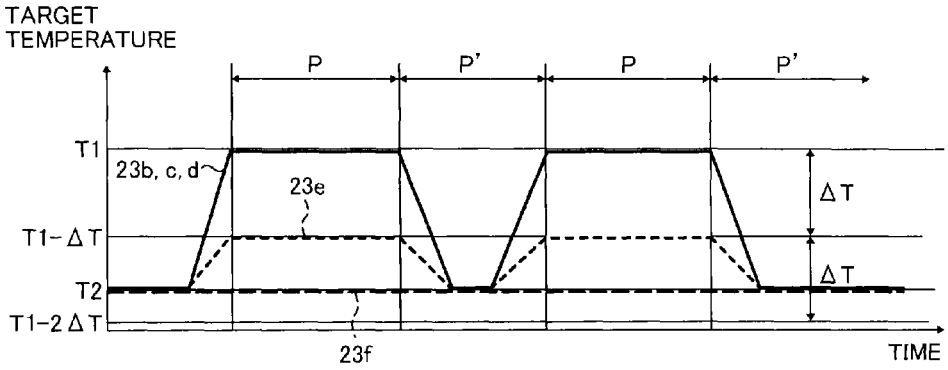
FIG. 7 is a graph of control temperatures of the heat generators to heat the sheet of FIG. 5A according to a first example of selective heat control.

FIG. 7 is a graph of control temperatures of the heat generators 23*b* through 23*f* when the plurality of sheets P3 having the same image formation pattern illustrated in FIG. 5A are supplied and heated in the fixing device 20 of the present embodiment, according to a first example of selective heating control.

In the example of FIG. 7, the temperatures of the heat generators 23*b* through 23*d* are controlled to heat their respective heating areas corresponding to the imaged area C at the temperature T1 as a target fixing temperature during P, whereas the temperatures of the heat generators 23*b* through 23*d* are decreased to the temperature T2 as a target temperature during P'. Similar to the comparative example, heat control is not performed on the heat generators 23*a* and 23*g* because their respective heating areas are outside the width of the sheet S3.

In addition, the temperature of the heat generator 23*e* is controlled to be the temperature of T1−ΔT, which is a temperature obtained by subtracting the target heating temperature difference ΔT from the fixing temperature T1, as a target temperature during P, whereas the temperature of the heat generator 23*e* are decreased to the temperature T2 as a target temperature during P'. It is to be noted that, of the heat generators having their respective heating areas corresponding to the blank area D, the heat generator 23*e* is located closest to the heat generator 23*d* having its heating area corresponding to the imaged area C.

The target heating temperature difference ΔT of the present embodiment is any value lower than the difference between the fixing temperature T1 and the temperature T2. A larger target heating temperature difference ΔT contributes to a higher energy efficiency whereas it generates a larger temperature difference between the heat generators 23*d* and 23*e*. A target heating temperature difference ΔT closer to the difference between the fixing temperature T1 and the temperature T2 more likely to wrinkle the sheet S3 as in the comparative example of selective heating control. For this reason, preferably, the target heating temperature difference ΔT is sufficiently lower than the difference between the fixing temperature T1 and the temperature T2.

According to the present embodiment, heating areas of a fixing member (e.g., fixing roller 22) heated by two adjacent heat generators, one of which corresponds to an imaged area (e.g., heat generator 23*d*) and the other corresponds to a blank area (e.g., heat generator 23*e*), acquire the target heating temperature difference ΔT that is lower than the difference between the fixing temperature T1 and the temperature T2. Accordingly, the fixing roller 22 is prevented from losing its central portion of reduced diameter and wrinkles in a recording medium (e.g., sheet S3) is further prevented.

In addition, heating areas of the fixing member heated by adjacent heat generators corresponding to the blank area preferably acquire the target heating temperature difference ΔT therebetween in a phased manner starting from the heat generator 23*e*. In other words, according to the present embodiment, the power supply is controlled such that the heating areas of the fixing member heated by the adjacent heat generators corresponding to the blank area acquire the target heating temperature difference ΔT in a phased manner starting from one of the adjacent heat generators corresponding to the blank area located adjacent to a heat generator corresponding to the imaged area. In the example of FIG. 5A, the heating areas of the fixing member heated by the heat generators 23*e* and 23*f* acquire the target heating temperature difference ΔT.

However, if ΔT is sufficiently large, in this case, if a relation of $(T1-T2)/2<\Delta T$ is satisfied, the temperature of the heat generator 23*f* is not higher than the temperature T2. Preferably, the temperature of the heat generator 23*f* is higher than the temperature T2 for a quick warm up of the heater 23. Hence, the power supply is preferably controlled such that the heating area of the fixing member heated by the heat generator 23*f* acquires a higher temperature of the temperature T2 and a temperature of $T1-2\cdot\Delta T$, which is a ΔT lower than the target temperature of $T1-\Delta T$ of the heat generator 23*e*.

In the example of FIG. 7, the temperature of $T1-2\cdot\Delta T$ is lower than the temperature T2. Accordingly, the temperature of the heat generator 23*f* is controlled to be the temperature T2 as a target temperature.

Figure 8:
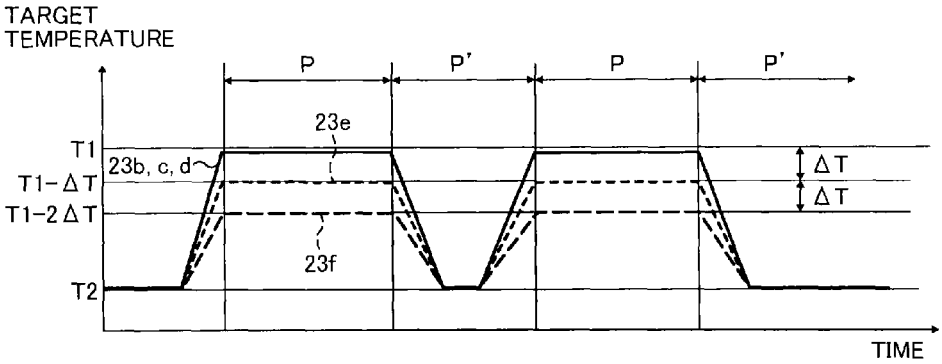
FIG. 8 is a graph of control temperatures of the heat generators to heat the sheet of FIG. 5A according to a second example of selective heat control.

By contrast, the target heating temperature difference ΔT is relatively small in an example of FIG. 8. FIG. 8 is a graph of control temperatures of the heat generators 23*b* through 23*f* when the plurality of sheets P3 having the same image formation pattern illustrated in FIG. 5A are supplied and heated in the fixing device 20 of the present embodiment, according to a second example of selective heating control.

In the example of FIG. 8, the temperature of $T1-2\cdot\Delta T$ is higher than the temperature T2. Accordingly, the temperature of the heat generator 23*f* is controlled to be the temperature of $T1-2\cdot\Delta T$ as a target temperature.

Since a smaller temperature difference ΔT reduces energy efficiency while having a larger effect of preventing wrinkles in the sheet S3, an optimum temperature difference ΔT is specified depending on conditions. For example, a thinner sheet S3 is more easily wrinkled. Accordingly, a relatively small temperature difference ΔT is specified as in the second example illustrated in FIG. 8. By contrast, a thicker sheet S3 is less easily wrinkled. Accordingly, a relatively large temperature difference ΔT is specified to reduce energy consumption.

According to the present embodiment, two heat generators are used to heat the blank area and the power supply for the two heat generators are controlled as described above. Alternatively, three or more heat generators may be used to heat the blank area and the power supply for the three or more heat generators may be similarly controlled. In other words, it is determined whether a control temperature is not lower than the temperature T2. If a relation of $T1-n\cdot\Delta T>T2$ is satisfied, the power supply is controlled such that a heating area of the fixing member heated by an n-th heat generator of the heat generators corresponding to the blank area acquires a temperature of $T1-n\cdot\Delta T$, where "n" represents an order of the heat generators corresponding to the blank area starting from 1 with the one of the heat generators corresponding to the blank area located adjacent to the heat generator corresponding to the imaged area. If a relation of $T1-n\cdot\Delta T<T2$ is satisfied, the power supply is controlled such that the heating area of the fixing member heated by the n-th heat generator acquires the temperature T2.

Upon duplex printing, the first side of the sheet S passes through the fixing device 20, and then a second side of the sheet S passes therethrough. Particularly, a sheet S that is not uniformly heated in a longitudinal direction thereof (e.g., sheet S3) is most likely to be wrinkled when the sheet S passes through the fixing device 20 again. In short, upon duplex printing, the sheet S is more likely to be wrinkled when the second side thereof passes through the fixing device 20 than when the first side thereof passes through the fixing device 20.

Hence, in the image forming apparatus 1 of the present embodiment, the heat controller 27 changes ΔT between when the first side of the sheet S is printed upon duplex printing and upon single-sided printing. ΔT is also changed between when the first side of the sheet S is printed upon duplex printing and when the second side of the sheet S is printed upon duplex printing. According to the present embodiment, ΔT may be the same or different between when the second side of the sheet S is printed upon duplex printing and upon single-sided printing.

For example, a smaller ΔT is specified for the first side of the sheet S passing through the fixing device 20 upon duplex printing than a ΔT specified for single-sided printing. The smaller ΔT eliminates an uneven heating of the sheet S in the longitudinal direction thereof and prevents wrinkles on the second side of the sheet S upon duplex printing. In such a case, a relation of $\Delta T=0$ may be satisfied when the first side of the sheet S is printed. In other words, selective heat control may not be performed when the first side of the sheet S is printed whereas the selective heat control may be performed only when the second side of the sheet S is printed.

As described above, in an image forming apparatus (e.g., image forming apparatus 1 according to the present embodiment, a fixing device (e.g., fixing device 20) selectively heats an imaged area by specifying a fixing temperature (e.g., fixing temperature T1) corresponding to the imaged area and a temperature (e.g., temperature T2) corresponding to a blank area. A heat controller (e.g., heat controller 27) controls a power source (e.g., power source 24) that supplies electric power for heat generators (e.g., heat generators 23*a* through 23*g*) such that a target temperature difference between adjacent heat generators is lower than a temperature difference between the fixing temperature T1 and the temperature T2. In addition, the target temperature difference between the adjacent heat generators is controlled to be not larger than a predetermined temperature to prevent a precipitous temperature difference in a longitudinal direction of a fixing member (e.g., fixing roller 22).

Accordingly, the fixing member and a pressing member (e.g., pressing roller 21) disposed opposite the fixing member are not deformed due to thermal expansion difference, thereby preventing wrinkles in a recording medium (e.g., sheet S). Particularly, when the fixing member is a drum-shaped fixing roller having a central portion of reduced diameter, the shape of the fixing roller is maintained to prevent wrinkles in the recording medium.

Wrinkles in the recording medium is noticeable when the recording medium is unevenly heated or unevenly absorbs moisture in a longitudinal direction thereof. Accordingly, upon duplex printing, the second side of the sheet S may be wrinkled after the first side thereof is heated. To prevent such wrinkles on the second side of the sheet S, a smaller target heating temperature difference ΔT is specified for the first side of the sheet S upon duplex printing so that heat control is performed in a manner similar to an uniform heat control.

Preferably, the target heating temperature difference ΔT is changed according to the thickness of the recording medium. Generally, thinner sheets are more easily wrinkled whereas thicker sheets are less easily wrinkled even if the drum-shaped fixing roller is deformed and loses its central portion of reduced diameter. Accordingly, a smaller ΔT is specified for a thinner sheet whereas a larger ΔT is specified for a thicker sheet. The above-described control may not be performed when a recording medium having a certain thickness (e.g., 105 gsm or larger) is used because such recording medium are not wrinkled. In such a case, heat control is performed as in the comparative example of selective heat control.

Accordingly, wrinkles in the recording medium can be effectively prevented and power consumption can be reduced.

In addition, the target heating temperature difference ΔT is preferably changed according to the type of the recording medium. Generally, tough sheets are hardly wrinkled, such as overhead projector (OHP) sheets and coated sheets. Accordingly, a larger target heating temperature difference ΔT is specified for the OHP sheets and coated sheets than a target heating temperature difference ΔT specified for plain sheets. By contrast, a smaller target heating temperature difference ΔT is specified for sheets easily wrinkled, such as envelopes, than the target heating temperature difference ΔT specified for plain sheets.

Accordingly, wrinkles in the recording medium can be effectively prevented and power consumption can be reduced.

Preferably, the above-described target heating temperature difference ΔT is obtained by e.g., experiments beforehand for each occasion, that is, upon single-sided printing, when the first side of the recording medium is printed upon duplex printing, and when the second side of the recording medium is printed upon duplex printing. In addition, the target heating temperature difference ΔT is preferably obtained beforehand for each type or thickness of the recording medium or a combination of the type and thickness of the recording medium.

It is to be noted that the target heating temperature difference ΔT is stored in a memory of the heat controller 27 as a parameter table.

Referring now to FIGS. 9 through 11, a description is given of the parameter table.

FIG. 9 is a parameter table of ΔT specified for single-sided printing. FIG. 10 is a parameter table of ΔT specified for the first side of the sheet S upon duplex printing. FIG. 11 is a parameter table of ΔT specified for the second side of the sheet S upon duplex printing.

A target heating temperature difference ΔT is read out corresponding to, e.g., a printing type (e.g., duplex printing), paper thickness and/or paper type designated via an input device such as an operation panel for printing. A power supply for the heat generators is controlled according to the target heating temperature difference ΔT.

It is to be noted that, when a recording medium having a certain thickness is used, heat control is performed in the same manner as the comparative example of selective heat control because such a recording medium are not wrinkled, by satisfying a relation of ΔT=T1−T2 for an endmost heat generator corresponding to the blank area.

It is to be noted that the number of constituent elements and their locations, shapes, and so forth are not limited to any of the structure for performing the methodology illustrated in the drawings.

For example, the above-described fixing device 20 employs a roller-type fixing system. Alternatively, however, the fixing device 20 may employ a belt-type or film-type fixing system. The pressing member may be, e.g., a belt instead of a roller. In addition, the heater is not limited to the above-described example as long as the heater has a plurality of heating areas in the longitudinal direction of the fixing member that can be individually controlled.

This disclosure has been described above with reference to specific embodiments. It is to be noted that this disclosure is not limited to the details of the embodiments described above, but various modifications and enhancements are possible without departing from the scope of the invention. It is therefore to be understood that this disclosure may be practiced otherwise than as specifically described herein. For example, elements and/or features of different illustrative embodiments may be combined with each other and/or substituted for each other within the scope of the present invention.

What is claimed is:

1. An image forming apparatus comprising:

a rotatable fixing member to contact an unfixed image;

a pressing member disposed opposite the fixing member to form a fixing nip between the pressing member and the fixing member;

a plurality of heat generators arrayed in a longitudinal direction perpendicular to a direction in which a recording medium is conveyed to heat respective heating areas of the fixing member;

a plurality of temperature detectors disposed to detect a surface temperature of the fixing member and temperatures of the plurality of heat generators;

a power source to supply electric power to the plurality of heat generators to heat the respective heating areas; and a heat controller to control the power source according to data provided by the temperature detectors, such that, when the unfixed image on the recording medium conveyed to the fixing nip contains an imaged area and a blank area, a temperature T2 corresponding to the blank area is lower than a temperature T1 corresponding to the imaged area, wherein the plurality of heat generators include a first heat generator to heat a heating area of the fixing member corresponding to the imaged area and a plurality of second heat generators to heat heating areas of the fixing member corresponding to the blank area, wherein the heat controller controls the power source such that one of the plurality of second heat generators located adjacent to the first heat generator is set to a temperature of T1−ΔT, where ΔT is a temperature lower than a difference between the temperature T1 and the temperature T2, when the unfixed image on the recording medium conveyed to the fixing nip contains the imaged area and the blank area, and wherein the heat controller changes ΔT between when a first side of the recording medium is printed upon duplex printing and upon single-sided printing.

2. The image forming apparatus according to claim 1, wherein the heat controller changes ΔT between when the first side of the recording medium is printed upon the duplex printing and when a second side of the recording medium is printed upon the duplex printing.

3. The image forming apparatus according to claim 1, wherein the heat controller sets ΔT to zero when the first side of the recording medium is printed upon the duplex printing.

4. The image forming apparatus according to claim 1, wherein the heat controller controls the power source such that heating areas of the fixing member heated by adjacent heat generators of the plurality of second heat generators acquire a temperature difference of ΔT therebetween in a phased manner starting from the one of the plurality of second heat generators located adjacent to the first heat generator, and wherein the heat controller determines whether a control temperature is not lower than the temperature T2, and controls the power source such that, if a relation of $T1-n\cdot\Delta T>T2$ is satisfied, a heating area of the fixing member heated by an n-th heat generator of the plurality of second heat generators acquires a temperature of $T1-n\cdot\Delta T$, where "n" represents an order of the plurality of second heat generators starting from 1 with the one of the plurality of second heat generators located adjacent to the first heat generator, and if a relation of $T1-n\cdot\Delta T<T2$ is satisfied, the heating area of the fixing member heated by the n-th heat generator acquires the temperature T2.

5. The image forming apparatus according to claim 1, wherein the heat controller changes ΔT according to a thickness of the recording medium.

6. The image forming apparatus according to claim 1, wherein the heat controller changes ΔT according to a type of the recording medium.

7. A fixing device comprising:

a rotatable fixing member to contact an unfixed image;

a pressing member disposed opposite the fixing member to form a fixing nip between the pressing member and the fixing member; and a plurality of heat generators arrayed in a longitudinal direction perpendicular to a direction in which a recording medium is conveyed to heat respective heating areas of the fixing member such that, when the unfixed image on the recording medium conveyed to the fixing nip contains an imaged area and a blank area, a temperature T2 corresponding to the blank area is lower than a temperature T1 corresponding to the imaged area, wherein the plurality of heat generators include a first heat generator to heat a heating area of the fixing member corresponding to the imaged area and a plurality of second heat generators to heat heating areas of the fixing member corresponding to the blank area, wherein one of the plurality of second heat generators located adjacent to the first heat generator is set to a temperature of $T1-\Delta T$, where ΔT is a temperature lower than a difference between the temperature T1 and the temperature T2, when the unfixed image on the recording medium conveyed to the fixing nip contains the imaged area and the blank area, and wherein ΔT is different between when a first side of the recording medium is printed upon duplex printing and upon single-sided printing.

8. The fixing device according to claim 7, wherein ΔT is different between when the first side of the recording medium is printed upon the duplex printing and when a second side of the recording medium is printed upon the duplex printing.

9. The fixing device according to claim 7, wherein ΔT is zero when the first side of the recording medium is printed upon the duplex printing.

10. The fixing device according to claim 7, wherein ΔT depends on a thickness of the recording medium.

11. The fixing device according to claim 7, wherein ΔT depends on a type of the recording medium.

* * * * *